US009717936B2

(12) United States Patent
Ancone et al.

(10) Patent No.: US 9,717,936 B2
(45) Date of Patent: Aug. 1, 2017

(54) SPRINKLER ASSEMBLY

(71) Applicant: Tyco Fire Products LP, Lansdale, PA (US)

(72) Inventors: Mathew R. Ancone, Warwick, RI (US); Sean E. Cutting, West Warwick, RI (US); Lyle Miller, Framington, MA (US)

(73) Assignee: Tyco Fire Products LP, Lansdale, PA (US)

( * ) Notice: Subject to any disclaimer, the term of this patent is extended or adjusted under 35 U.S.C. 154(b) by 208 days.

(21) Appl. No.: 14/430,136

(22) PCT Filed: Sep. 20, 2013

(86) PCT No.: PCT/US2013/060997

§ 371 (c)(1),
(2) Date: Mar. 20, 2015

(87) PCT Pub. No.: WO2014/047485

PCT Pub. Date: Mar. 27, 2014

(65) Prior Publication Data

US 2015/0246252 A1 Sep. 3, 2015

Related U.S. Application Data

(60) Provisional application No. 61/704,414, filed on Sep. 21, 2012.

(51) Int. Cl.
*A62C 35/68* (2006.01)
*A62C 37/11* (2006.01)
(Continued)

(52) U.S. Cl.
CPC ..... *A62C 35/68* (2013.01); *A62C 37/00* (2013.01); *A62C 37/11* (2013.01); *B05B 1/265* (2013.01)

(58) Field of Classification Search
CPC ..... A62C 31/02; A62C 35/68; A62C 37/00; A62C 37/11; A62C 37/12; A62C 37/14; A62C 37/16; B05B 1/265
USPC ..... 169/37, 38, 40, 58
See application file for complete search history.

(56) References Cited

U.S. PATENT DOCUMENTS 4,580,729 A 4/1986 Pounder
4,981,179 A 1/1991 Klein
(Continued)

FOREIGN PATENT DOCUMENTS

EP 0692280 1/1996
GB 2188841 10/1987

OTHER PUBLICATIONS

International Search Report and Written Opinion dated Jul. 3, 2014, International Application No. PCT/US2013/060997 filed on Sep. 20, 2013, 10 pages.
(Continued)

*Primary Examiner* — Darren W Gorman
(74) *Attorney, Agent, or Firm* — Perkins Coie LLP

(57) ABSTRACT

A sprinkler assembly that includes a frame having a body including an inlet, an outlet and an internal passageway extending between the inlet and the outlet to define a longitudinal sprinkler axis. Two frame arms extend distally from the body, and each arm has a portion defining a cross-sectional area with a lateral surface and a medial surface spaced about a first plane bisecting the body with the sprinkler axis disposed in the first plane. An axially aligned thermally responsive glass-bulb type trigger is disposed along the sprinkler axis. The cross-sectional areas of the frame arms are asymmetrical with respect to one another about the first plane and each cross-sectional area is asymmetric about a second plane perpendicular to the first plane. The lateral surface of each arm includes an undulation to provide the sprinkler assembly with substantially consistent thermal sensitivity about the sprinkler axis.

39 Claims, 9 Drawing Sheets

(51) Int. Cl.

| | |
|---|---|
| ***A62C 37/14*** | (2006.01) |
| ***B05B 1/26*** | (2006.01) |
| ***A62C 37/00*** | (2006.01) |

(56) References Cited

U.S. PATENT DOCUMENTS

| | | | | |
|---|---|---|---|---|
| 5,664,630 | A | 9/1997 | Meyer et al. | |
| 5,732,778 | A * | 3/1998 | Tateno | A62C 37/11 169/37 |
| 5,829,532 | A | 11/1998 | Meyer et al. | |
| 6,336,509 | B1 * | 1/2002 | Polan | A62C 37/11 169/37 |
| 6,450,265 | B1 | 9/2002 | Ponte | |
| 6,585,054 | B1 * | 7/2003 | Thomas | A62C 31/02 169/37 |
| 7,165,624 | B1 * | 1/2007 | Fischer | A62C 31/02 169/16 |
| 2008/0073088 | A1 | 3/2008 | Ide et al. | |
| 2011/0036598 | A1 * | 2/2011 | Pahila | A62C 3/002 169/37 |

OTHER PUBLICATIONS

IFW, U.S. Appl. No. 61/704 414, filed Sep. 21, 2012, 126 pages.
IFW, European Patent Application No. 13771716.1, filed on Sep. 20, 2013, 220 pages.
Tyco Fire Protection Products Datasheet TFP330, Feb. 2012, Ultra K17™-16.8 K factor™, 4 pages.

* cited by examiner

SPRINKLER ASSEMBLY

PRIORITY CLAIM & INCORPORATION BY REFERENCE

This application is a 35 U.S.C. §371 application of International Application No. PCT/US2013/060997 filed Sep. 20, 2013, which claims the benefit of priority to U.S. Provisional Patent Application No. 61/704,414, filed Sep. 21, 2012, each of which is incorporated by reference in its entirety.

BACKGROUND OF THE INVENTION

Automatic sprinkler systems are some of the most widely used devices for fire protection. These systems have sprinklers that are actuated once the ambient temperature in an environment, such as a room or building exceeds a predetermined value. Once activated, the automatic sprinklers distribute fire-extinguishing fluid, preferably water, in the room or building. Generally, an automatic sprinkler includes a sprinkler frame, a fluid deflecting element and a thermally responsive trigger which: (i) works with a fluid seal member to seal the sprinkler in an unactuated state of the sprinkler; and (ii) operates or actuates in response to an appropriate level of ambient temperature to release the seal in an actuated state of the sprinkler A typical sprinkler frame includes a body having an inlet end configured to couple the sprinkler to a fluid supply pipe and an outlet end to discharge the fire fighting fluid. The sprinkler body includes a fluid passageway which defines a central sprinkler axis. Depending from the body are a pair of frame arms which support the fluid deflecting element. Shown in U.S. Pat. Nos. 6,336,509 and 5,664,630 are known sprinkler frame arrangements. As shown in FIG. 1 of U.S. Pat. No. 5,664,630, a thermal trigger in the form of a glass bulb can be mounted between the frame arms and axially aligned along the sprinkler axis (directly loaded position) to support a fluid seal member at the outlet of the sprinkler. A thermally responsive glass-bulb type thermal trigger contains an expansible liquid that expands with rising temperatures to cause the glass bulb to break into small fragments at a predetermined nominal release temperature range, i.e., the nominal temperature rating, thereby actuating the sprinkler Thermal responsiveness or sensitivity can be defined as the rapidity with which a trigger operates in response to a fire or other heat source. Accordingly, thermal responsiveness may be characterized as either standard response, quick-response or fast-response.

One measure of thermal sensitivity of a heat responsive element or trigger is the Response Time Index or "RTI," which is related to the thermal inertia of the element. According to the description in U.S. Pat. No. 5,829,532, when "fast response" was being investigated in the 1980's, "standard sprinklers" were found to have an RTI of more than 100 meter$^{1/2}$second$^{1/2}$ ("$m^{1/2}sec^{1/2}$") or more typically up to nearly 400 $m^{1/2}sec^{1/2}$; and for sprinklers that were found to thermally respond faster than standard sprinklers, the RTI was found to be less than 100 $m^{1/2}sec^{1/2}$. Currently under NFPA 13, Section 3.6.1, a "fast response" sprinkler is defined as a sprinkler having a thermal element with an RTI of 50 $m^{12}sec^{1/2}$ or less; and a "standard response" sprinkler is defined as a sprinkler having a thermal element with an RTI of 80 $m^{1/2}sec^{1/2}$ or more. Historically, a class of "special" faster operating sprinkler had been recognized having RTI's between 80 and 50 $m^{1/2}sec^{1/2}$. For one type of fast-response sprinkler, the early suppression fast response ("ESFR") sprinkler, the thermal trigger has an RTI of 50 $m^{1/2}sec^{1/2}$ or less, more particularly 40 $m^{1/2}sec^{1/2}$ and even more particularly 19 to 36 $m^{1/2}sec^{1/2}$. It was once believed for fast-growing industrial fires of the type to be protected by ESFR sprinklers, that the RTI and the temperature rating together ensured adequate fast sprinkler response. Accordingly, some ESFR sprinklers include a trigger having an RTI of less than 40 $m^{1/2}sec^{1/2}$ and a temperature rating of 165° F. or 214° F. However, as described in U.S. Pat. No. 5,829,532 one embodiment of a sprinkler provided suppression of a high challenge fire with an trigger having an RTI of less than 100 $m^{1/2}sec^{1/2}$. Accordingly, as used herein, fast-response triggers can be characterized by RTI's of less than 100 $m^{1/2}sec^{1/2}$; 80 $m^{1/2}sec^{1/2}$ or less; 50 $m^{1/2}sec^{1/2}$ or less; 40 or less $m^{1/2}sec^{1/2}$ or ranging between 19 to 36 $m^{1/2}sec^{1/2}$.

The frame arms define a window about the thermal trigger. Heat flow in a direction through the frame window and normal to the plane defined by the frame arms is unobstructed to impact the thermal trigger. Depending on the construction of the frame arms and/or trigger, the arms may interfere with the heat flow in the plane of the window and directed laterally to the frame arms, which can inhibit the heat transfer to the thermal trigger thereby delaying responsiveness of the sprinkler To eliminate or minimize the interference of the frame arms in some sprinklers, particularly those requiring a fast response such as for example Early Suppression Fast Response (ESFR) sprinklers, the thermal trigger is off-set from the sprinkler axis to ensure appropriate thermal responsiveness. Alternatively or in addition to, the trigger may include additional structures, such as for example, heat conducting fins, as seen for example in FIG. 7 of U.S. Pat. No. 4,981,179 to facilitate the responsiveness of the trigger. Instead of using a glass-type bulb trigger, a sprinkler may alternatively use a multi-component trigger assembly such as, for example, a lever and strut solder assembly. These alternative trigger arrangements however, present more components and complexity as compared to the axially disposed bulb.

There are industry accepted test standards to evaluate thermal sensitivity of a sprinkler and its trigger. For example, a "Sensitivity Test" is described in Section 21 of the UL Standard for Early-Suppression Fast-Response Sprinklers UL 1767 (2010) a copy of which is attached to U.S. Provisional Patent Application No. 61/704,414. A similar test is set forth in another standard: the "Sensitivity-Response Time Index (RTI)" test described in section 4.28 of the FM Approval Standard Class No. 2008 (2006), which is attached to U.S. Provisional Patent Application No. 61/704,414. As described in the test standards, the sensitivity of the sprinkler is evaluated by subjecting the sprinkler to an air flow of a temperature sufficient to activate the thermal trigger of the sprinkler For Early-Suppression Fast-Response (ESFR) Sprinklers under the UL test standard, the thermal sensitivity testing requires the sprinkler to be evaluated relative to the air flow in a "most favorable position with respect to achieving a minimum operation time" and a "least favorable position with respect to achieving a maximum operating time." For some sprinklers, the "most favorable position" can be an orientation where the air flow impacts a sprinkler such that the frame arms do not block the flow of air to the thermal trigger so as to provide the greatest heat transfer to the trigger, and the "least favorable position" can be an orientation where one of the frame arms is interposed between the air flow and the thermal trigger so as to limit the delivery of heat to the thermal trigger. For some other types of sprinklers not requiring "fast response" actuation, the industry approved testing may only require the "most favorable position testing."

In addition to being thermally responsive, the thermal trigger must be sufficiently strong in the unactuated state of the sprinkler, to support the fluid seal element and the force generated by the fluid pressure delivered to the sprinkler, which may be as much as for example, 175 psi. Because the sprinkler frame supports the thermal trigger, loads are transferred to the sprinkler frame. Accordingly, sprinklers are typically designed to meet strength testing of the frame structure that extends between the fluid outlet of the sprinkler to the fluid deflecting structure mounted on the frame structure.

One standard for testing the strength of a sprinkler frame is the "Strength of Frame Test" described in Underwriters Laboratories' ("UL"), Section 26 of the UL Standard for Early-Suppression Fast-Response Sprinklers UL 1767 (2010) which is attached to U.S. Provisional Patent Application No. 61/704,414. As described in the UL standard, a sprinkler frame must not show permanent distortion when certain loads are applied to the frame. As can be appreciated, a short frame structure can provide greater strength as compared to a similarly-designed long frame structure because there is less moment associated with a short frame. A similar test is set forth in another standard: FM Global's ("FM") "Assembly Load/Frame Strength" test described in section 4.2 of the FM Approval Standard Class No. 2008 (2006) which is attached to U.S. Provisional Patent Application No. 61/704,414.

DISCLOSURE OF THE INVENTION

A preferred sprinkler assembly includes a sprinkler frame arrangement in combination with a thermal trigger such that the sprinkler maintains its expected or rated thermal sensitivity substantially consistently radially about the sprinkler axis. The preferred sprinkler frame includes frame arms configured to deflect or redirect heat flow impacting the lateral surfaces of the frame arms toward the sprinkler axis and in particular toward a directly loaded thermal trigger, such as for example, a glass bulb type thermal trigger disposed on the sprinkler axis.

One preferred embodiment provides a sprinkler assembly that includes a sprinkler frame having a body having an inlet, an outlet and an internal passageway extending between the inlet and the outlet to define a longitudinal sprinkler axis. The frame includes two frame arms which extend distally from the body. Each frame arm has a portion defining a cross-sectional area with a lateral surface and a medial surface relative to the sprinkler axis, the medial surfaces being equally spaced about a first plane bisecting the body with the sprinkler axis disposed in the first plane. A seal assembly is disposed in the outlet to occlude the sprinkler outlet; and a fluid deflecting structure is supported by the frame arms. A thermally responsive glass-bulb type trigger is disposed between the frame arms and axially aligned along the sprinkler axis between the seal assembly and the frame to support the seal assembly in the outlet. The cross-sectional areas of the preferred frame arms are asymmetrical with respect to one another about the first plane and each cross-sectional area is asymmetric about a second plane perpendicular to the first plane with the sprinkler axis disposed in the second plane. Moreover, the lateral surface of each arm includes an undulation to provide the sprinkler assembly with substantially equivalent or consistent thermal sensitivity in all radial directions about the sprinkler axis.

The preferred sprinkler frame arrangements provide the sprinkler assembly with substantially equivalent or consistent thermal sensitivity in all radial directions about the sprinkler axis. More specifically, the preferred sprinkler with a glass-bulb type axially disposed and directly loaded thermal trigger, when subject to thermal sensitivity testing, thermally responds as expected in each of its most and least favorable positions. Thus, the preferred sprinkler assembly responds or actuates appropriately independent of the location of the heat source or other activation event relative to the sprinkler axis. More particularly, the preferred sprinkler assembly responds with a thermal sensitivity ranging between 19-36 $m^{1/2}$-$sec^{1/2}$when tested in its least favorable position. In one preferred embodiment, a sprinkler includes a body having an inlet, an outlet and an internal passageway extending between the inlet and the outlet to define a longitudinal sprinkler axis and a nominal K-factor of at least 14.0 GPM/$(PSI)^{1/2}$. A seal assembly is disposed in the outlet to occlude the sprinkler outlet. A fluid deflecting member is preferably spaced from the outlet at a first axial distance and spaced from the inlet at a second axial distance. A fast-response thermally responsive trigger is disposed axially aligned along the sprinkler axis between the seal assembly and the deflecting member. The trigger has a nominal thermal sensitivity and a nominal release temperature. Preferably, the nominal thermal sensitivity is defined by an RTI of less than 100 $m^{1/2}sec^{1/2}$; more preferably 80 $m^{1/2}sec^{1/2}$ or less; even more preferably 50 $m^{1/2}sec^{1/2}$ or less; yet more preferably 40 or less $m^{1/2}sec^{1/2}$; or preferably ranging between 19 to 36 $m^{1/2}sec^{1/2}$. Two frame arms extend distally from the body and are disposed about the thermally responsive trigger to support the fluid deflecting member from the outlet and the inlet. Each frame arm preferably defines a surface profile such that the thermal trigger responds to an activation event with the nominal thermal sensitivity and with the nominal release temperature independent of the location of the activation event about the sprinkler axis.

The preferred sprinkler frame arrangement provides for a compact sprinkler assembly satisfying all standard strength requirements, which may be used in several sprinkler applications and more preferably for use in an Early Suppression Fast Response Sprinkler Moreover, the compact sprinkler assembly facilitates the use of commercially available glass bulbs and minimize the amount of material in the fabrication of the sprinkler, while conforming with applicable standards for frame arm strength and thermal sensitivity in each of the least and most favorable testing positions. Accordingly, one particular preferred embodiment of the sprinkler assembly provides for an ESFR pendent type sprinkler having a nominal K-factor of 14.0 GPM/$(PSI)^{1/2}$. The preferred sprinkler assembly in which its thermal trigger is a fast-response trigger, the sprinkler having a substantially consistent RTI about its axis ranging between 19-36 $m^{1/2}$-$sec^{1/2}$. The preferred sprinkler frame provides a compact sprinkler assembly with a distal outlet-to-deflector distance of 1.25 inches which provides a more compact and more specifically an axially shorter assembly as compared to known existing fast response and more particular, known ESFR sprinklers.

In yet another preferred embodiment, a sprinkler include a frame having a body having an inlet, an outlet and an internal passageway extending between the inlet and the outlet to define a longitudinal sprinkler axis and a nominal K-factor of at least 14.0 GPM/(PSI)½. Two frame arms extending distally about the body and support the fluid deflecting structure 16 to define a preferred outlet to deflector axial distance ranging from about 1 inch to about 2.5 inches and an inlet to deflector axial distance ranging from about 1 inch to about 3.5 inches. A preferably fast response thermally responsive trigger is disposed in the frame window defined by the frame arms to support a seal assembly in the outlet, in which the frame window has an axial window height preferably ranging between about 1 inch and about 2 inch and a preferred window width of about 1 inch.

BRIEF DESCRIPTIONS OF THE DRAWINGS

The accompanying drawings, which are incorporated herein and constitute part of this specification, illustrate exemplary embodiments of the invention, and, together with the general description and attachments given above and the detailed description and attachments given below, serve to explain the features of the invention.

DETAILED DESCRIPTION OF THE PREFERRED EMBODIMENTS

A preferred sprinkler assembly provides for a sprinkler frame arrangement in combination with a directly-loaded axially disposed glass bulb-type trigger such that the glass bulb maintains its expected or rated thermal sensitivity substantially consistently radially about the sprinkler axis. More preferably, the preferred sprinkler, when subject to thermal sensitivity testing, thermally responds appropriately as expected or anticipated independent of the direction of the heat flow or location of an activation event relative to the sprinkler axis. Additionally, the preferred sprinkler frame arrangement provides for a compact sprinkler assembly, which facilitates the use of commercially available glass bulbs and minimizes the amount of material in the fabrication of the sprinkler, while conforming with standards for frame arm strength and thermal sensitivity in each of the least and most favorable testing positions.

Figure 1:
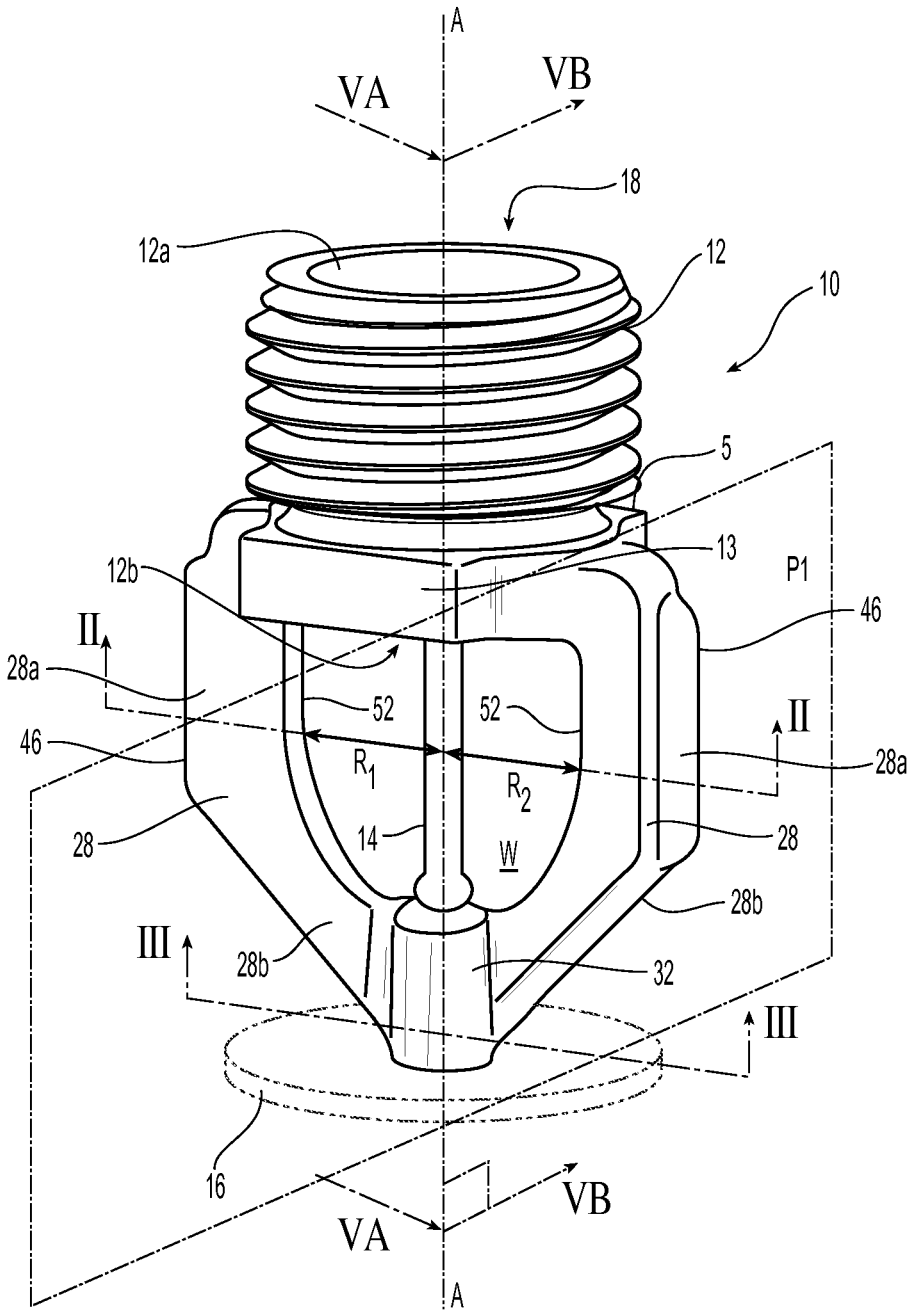
FIG. 1 illustrates an isometric view of an embodiment of a preferred sprinkler assembly.

Shown in FIG. 1 is an illustrative preferred embodiment of a sprinkler assembly 10 for installation in a fire protection piping network. The sprinkler assembly 10 includes a sprinkler frame 5, a fluid deflecting structure 16, and a thermal trigger 14 supporting a seal assembly (not shown) to seal the sprinkler in an unactuated configuration. The sprinkler frame 5 includes a body 12 having a proximal inlet 12*a*, a distal outlet 12*b*, and an internal passageway 18 which defines a sprinkler axis A-A. As shown, the thermal trigger 14, is disposed and axially aligned along the sprinkler axis A-A for direct loading upon installation of the sprinkler in a fire protection system. To couple the sprinkler 10 to a fluid supply pipe, the outer surface of the body 12 includes an externally threaded portion configured with, for example, National Pipe Thread (NPT) and a tool engagement surface 13. The tool engagement surface 13 preferably extends about the distal end 12*b* of the body and may include a plurality of flats for engagement with a tool such as a sprinkler wrench for threading the sprinkler 10 into a correspondingly threaded pipe fitting of the supply network.

The sprinkler frame 5 includes one and more preferably two frame arms 28 that are radially positioned on opposing sides of the distal outlet end 12*b* and preferably formed as a unitary member with the body 12. The frame arms 28 preferably extend axially and distally toward the deflector 16 and preferably converge toward the sprinkler axis A-A to terminate at a terminal frame formation axially aligned along the sprinkler axis A-A and spaced from the sprinkler distal outlet 12*b*. The terminal frame formation is preferably a substantially conical/frustoconical formation or knuckle 32. The fluid deflecting structure 16 is preferably coupled to the body 12 at the knuckle 32 so as to depend or be supported from the frame arms 28. The two frame arms 28 have axial portions 28*a* extending from the distal end 12*b* of the body 12 distally and parallel to the sprinkler axis A-A. The frame arms 28 further include converging portions 28*b* extending from the axial portions 28*a* at a converging angle toward each other and the axis A-A to terminate at the knuckle 32 and define a sprinkler window W.

Figure 2:
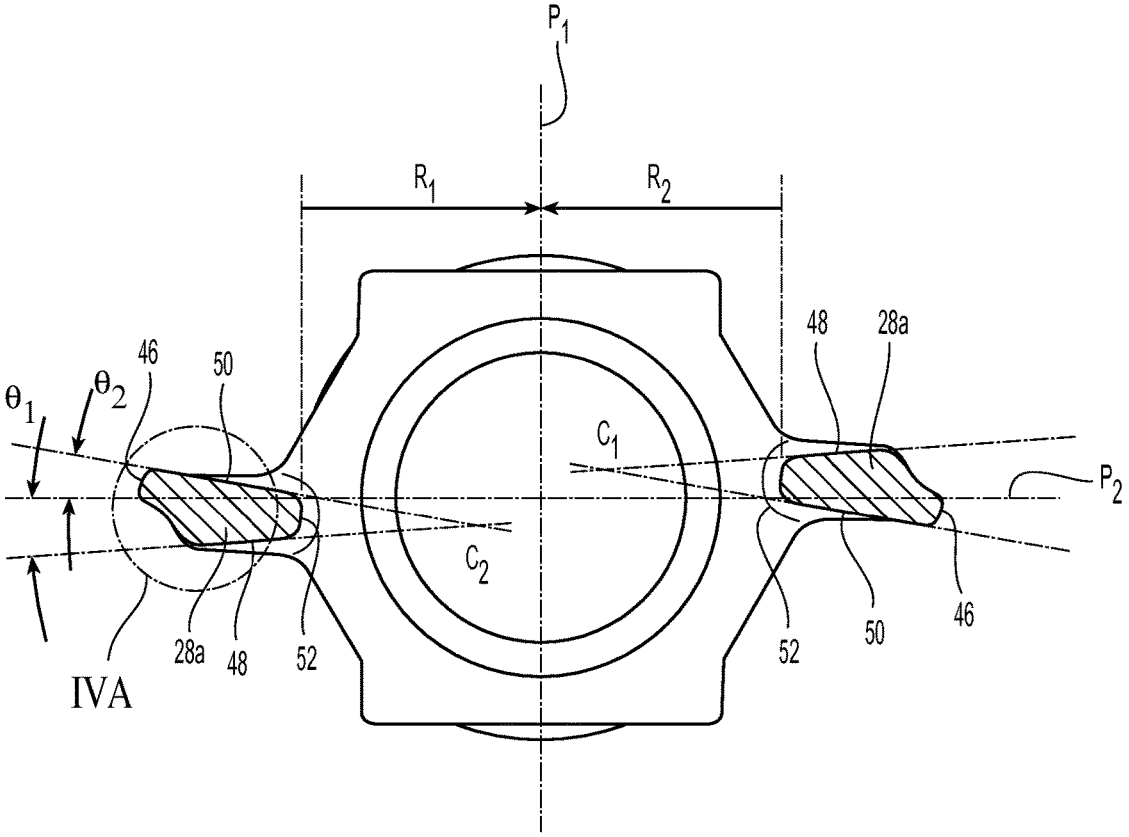
FIG. 2 illustrates a cross-sectional view of the sprinkler assembly taken along the axis II-II in the sprinkler assembly FIG. 1.

Each of the frame arms 28 and its vertical and converging portions 28*a*, 28*b* further define surface profiles to direct/deflect fluid and/or heat about the frame arms 28 and toward the sprinkler axis A-A and any sprinkler elements disposed along the axis A-A. More specifically, each frame arm includes a lateral surface 46 which is the radially outer most portion of the frame arm relative to the sprinkler axis A-A. The frame preferably defines a maximum lateral to lateral surface distance across the window frame W of about 1-¾ inches and more preferably about 1.78 inches. As used herein, the term "about" is understood as within a range of normal tolerance in the art, for example within 2 standard deviations of the mean. "About" can be understood as within 15%, 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about. The frame arms 28 further include a medial surface 52 which is the radially inner most portion of the frame arm relative to the sprinkler axis. As noted above, the frame arms 28 are preferably diametrically opposed about the distal outlet 12*b* of the body 12. Accordingly, the medial surface 52 of the pair of arms 28, preferably along the vertical portion 28*a*, are equidistantly disposed about a plane P1 that bisects the sprinkler body 12 with the sprinkler axis A-A disposed in the plane P1 such that the medial surfaces 52 define substantially equal distances R1 and R2 to the first plane P1. The medial surfaces 52 each defining a preferred distance to the first plane P1 of about ½ inch. Moreover in one particular embodiment, the vertical frame arm portions 28*a*, as seen in FIG. 2, are configured such that the medial surfaces 52 are disposed off-center with respect to a second plane P2 disposed perpendicular to the first plane P1 with the sprinkler axis A-A disposed in the second plane P2 and defining the intersection of planes P1, P2. More preferably, the center of the medial surface 52 of one arm 28 defines its center to one side of the second plane P2 and the center of the medial surface 52 of the other arm 28 defines its center on the opposite side of the second plane P2.

Connecting the lateral and medial surfaces 46, 52 to one another are spaced apart and opposed first surface 48 and second surface 50 which define the thickness of the frame arm and more particularly define the cross-sectional area of each of the frame arms. In cross-section, each of the frame arms 28 and more particularly its vertical portions 28*a* preferably taper in the lateral to the medial direction. Accordingly for each of the pair of arms 28, in one preferred aspect, the first and second surfaces 48, 50 converge toward one another to define first and second conversion points C1, C2 oppositely disposed about the second plane P2. With reference to FIG. 2, the conversion points C1, C2 are shown offset from one another with respect to and about the second plane P2.

Figure 3:
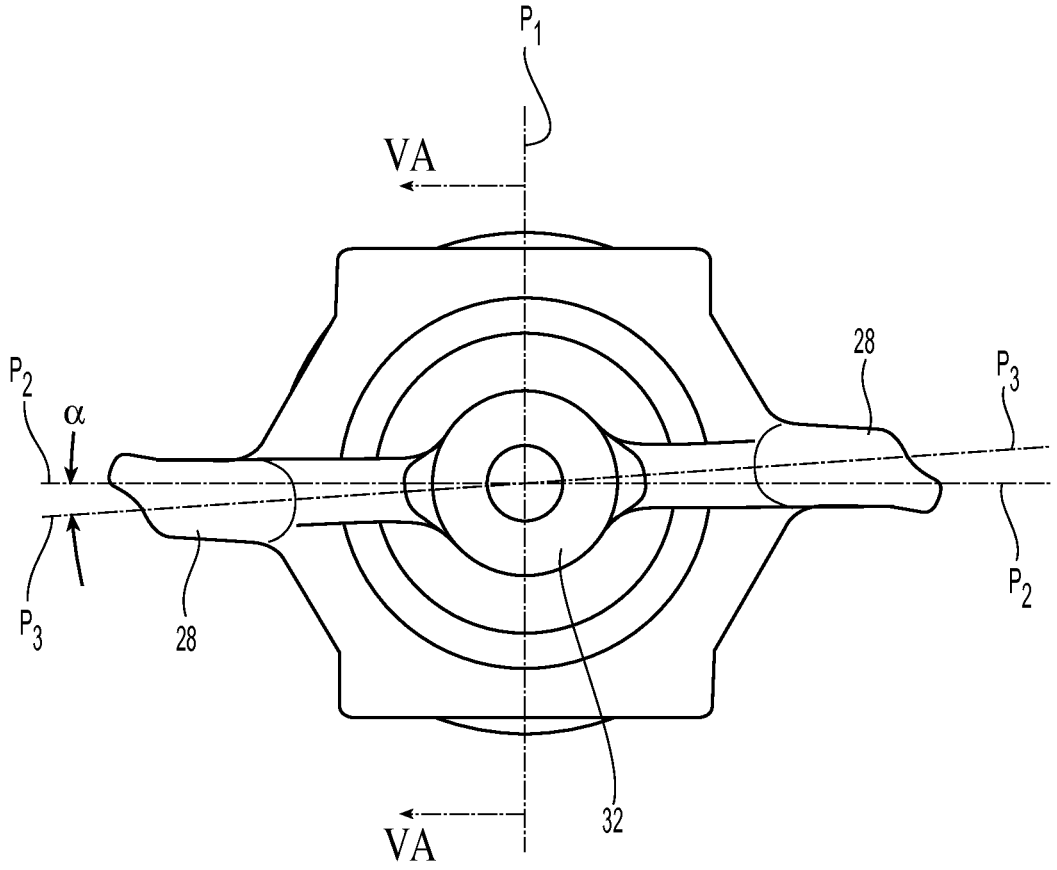
FIG. 3 illustrates a cross-sectional view of the sprinkler frame taken along the axis III-III in the sprinkler assembly of FIG. 1.

In one particular aspect of the frame arms 28 and their preferred perpendicular portions 28*a*, as shown in FIG. 2, the first surface 48 defines a skewed preferably acute angle θ1 relative to a line parallel to the second plane P2 which ranges from about 5° to about 10° and is more preferably about 9° to about 10°. The second surface 50 preferably defines a skewed, preferably acute angle θ2 relative to a line parallel to the second plane P2 which ranges from 1°-5° and is more preferably about 4°. Referring to FIG. 4A, the preferred converging arm surfaces 48, 50 and tapering cross-section define a maximum thickness tmax of the frame arm that ranges between about 0.10 inch to about 0.20 inch, preferably ranges between about 0.13 inch to about 0.17 inch and is more preferably about 0.17 inch. The preferred tapering cross-section defines a minimum thickness tmin which ranges from about 0.05 inches to about 0.15 inches, preferably ranges between about 0.07 inch to about 0.13 inch and is more preferably about 0.13 inch. Referring to FIG. 3, the arms extend distally and preferably converge toward the knuckle 32 to define a third plane P3 which bisects the arms 28 along their axial length and diametric alignment as shown in FIG. 3. More preferably, the third plane P3 is skewed with respect to the second plane P2 to define an angle α therebetween which preferably ranges between 0.5 to 5° and is more preferably 1°.

Figure 4B:
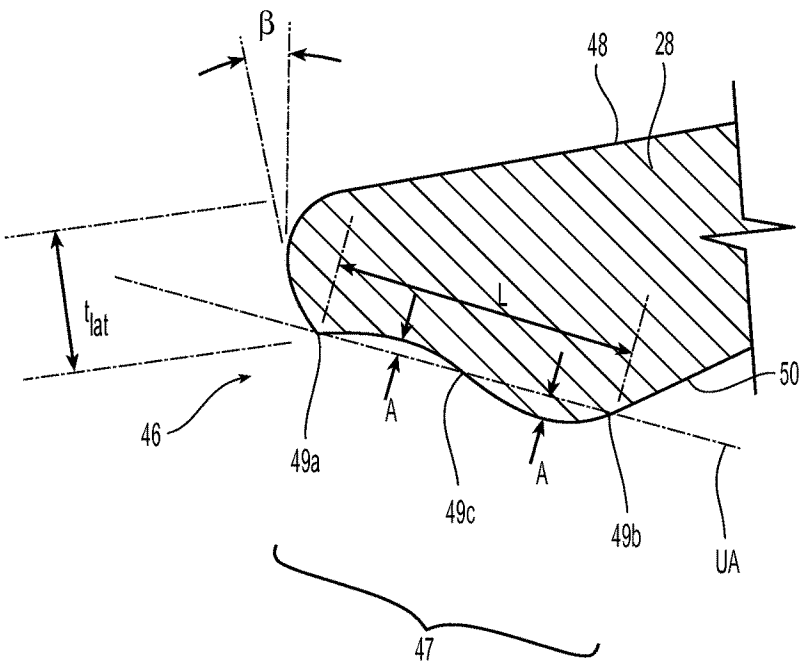
FIG. 4B is a detailed view of the cross-section of FIG. 4A.
Figure 4A:
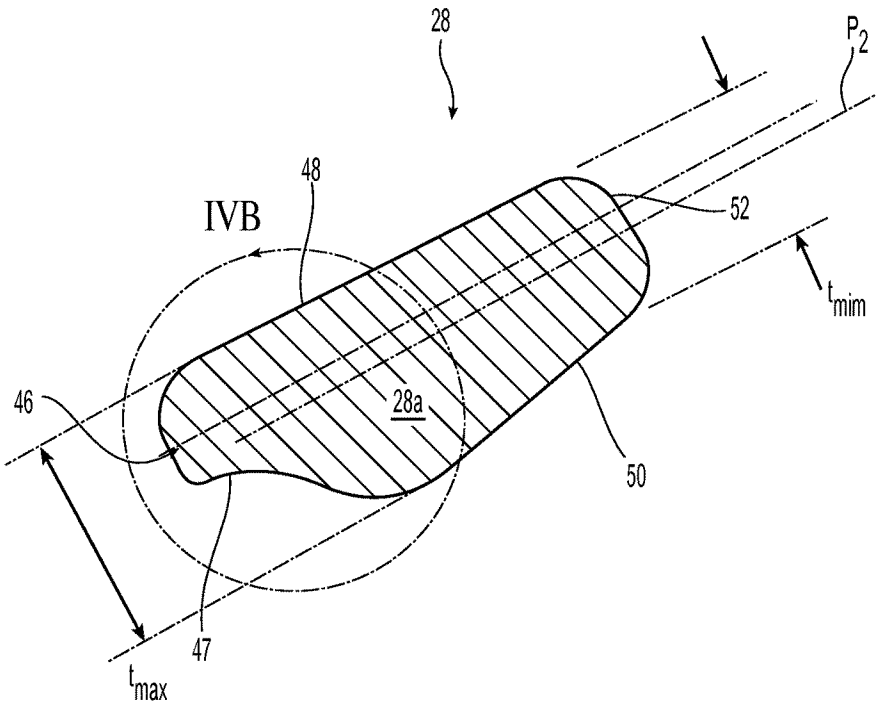
FIG. 4A is a detailed view of the cross-section of FIG. 2.

Referring to FIGS. 4A and 4B, the lateral portion and more preferably the lateral surface 46 includes a surface undulation 47 formed preferably contiguous to one of the first or second opposed surfaces 48, 50 of the frame arm 28. In one preferred embodiment, first surface 48 defines a lateral-to-medial length that is greater than the lateral-to-medial length defined by the opposed second surface 50. In one preferred embodiment, the first surface 48 defines a lateral-to-medial length of about 0.4 inches and the second surface 50 defines a lateral-to-medial length of about 0.3 inches. The lateral surface 46 of the preferred embodiment further preferably includes an undulation 47 that preferably defines a sine wave that is contiguous with the second frame surface 50 as seen in FIG. 4B. The preferred sine wave defines an axial wavelength L of about 0.3 millimeters over a preferred undulation axis UA defined by the linear alignment of three points of the undulation 47: a first end point 49*a*, a second end point 49*b* and an inflection point 49*c* between the first and second end points 49*a*, 49*b*. The preferred sine wave undulation 47 further preferably defines an amplitude A of about 0.2 millimeters and more preferably about 0.18 millimeters with respect to the undulation axis UA. Accordingly, for the preferred embodiment, the sinusoidal wave is defined by alternating convex and concave surfaces about the inflection point 49*c* with equivalent amplitudes from the undulation axis UA. Alternatively, the undulating surface 47 may be defined by multiple convex and concave surfaces which alternate about the inflection point 49*c* at variable or equivalent frequencies having variable amplitudes from the undulation axis UA. Further in the alternative, the undulating surface 47 may be defined by non-radiused surfaces. For example, the profile of the undulating surface 47 may be defined or formed in part by planar portions that alternately define positive and negatively linearly sloping surface relative to a common reference axis, such as for example, the undulating axis UA. In another alternate example, the undulating surface may be defined by planar surfaces which alternately extend parallel and perpendicular with respect to the reference axis. Accordingly, the undulating surface 47 may define in profile a saw tooth or a square waveform.

The lateral surface 46 may include other surface profiles contiguous with the undulating surface 47. For example, as seen in FIG. 4B, lateral surface 46 further preferably includes a surface portion disposed between and contiguous with each of the first surface 48 and the undulation 47. The lateral surface portion is preferably substantially linear defining a thickness $t_{lat}$ of about 0.1 inch and more preferably 0.8 inch and an included angle β with a line parallel to the first plane P1 of about ten degrees (10°) and is more preferably about 9°.

Figure 6A:
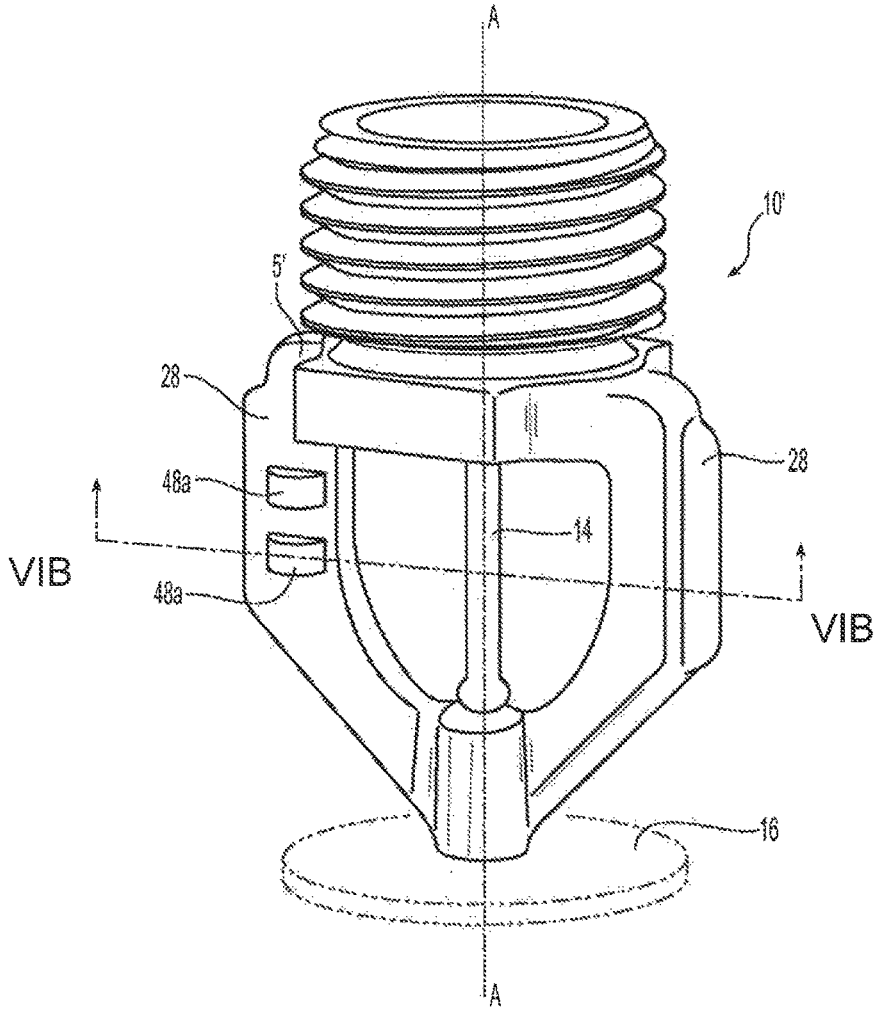
FIG. 6A illustrates an isometric view of another embodiment of a preferred sprinkler assembly.
Figure 6B:
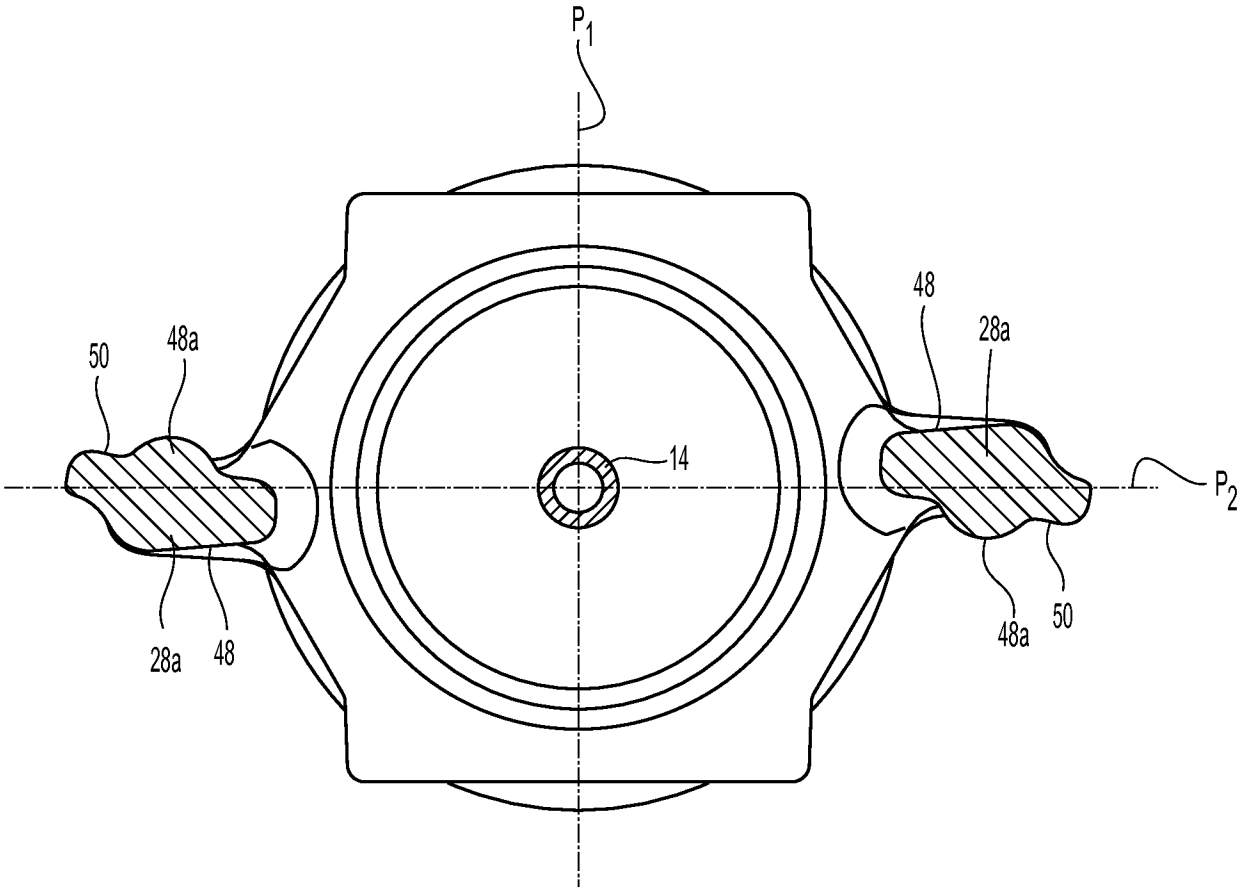
FIG. 6B illustrates a cross-sectional view of the sprinkler assembly taken along the axis VIB-VIB in the sprinkler assembly FIG. 6A.

Generally, the preferred embodiments provide that the sprinkler frame includes frame arms having surfaces along its portions which define cross-sectional areas, perpendicularly oriented with respect to the sprinkler axis A-A and asymmetrical about the first and second planes. More particularly, the various features of the frame arm locations and geometries define cross-sectional areas preferably located along the vertical portions 28*a* of the arms such that the cross-sectional areas of the arms are asymmetrical with respect to one another about the first plane P1; and more preferably, the cross-sectional areas themselves are asymmetrical about the second plane P2. Additionally or in the alternative, the first and second surfaces 48, 50 that are contiguous with the lateral and medial surfaces 46, 52 may define non-linear surface profiles to facilitate fluid and/or heat flow over the sprinkler frame 5. For example, in another embodiment of the sprinkler assembly 10' and frame 5', illustrated in FIGS. 6A and 6B, the second surface 50 can include one or more surface projections or bumps 48*a* that extends from the second surface 50 to further perturb or disturb the flow of heated air 42. Referring to FIG. 6A, the bump(s) 48*a* can be disposed intermittently along a length of the axial portions 28*a* of the frame arms 28, and have a profile that is curved preferably from a common center of curvature. Alternatively, the bump 48*a* can be continuous along the length of the axial portion 28*a* or frame arm 28, and have other profiles such as triangular or square. More generally, the projections are preferably disposed on each arms such that the arms define surface and cross-sectional profiles that are asymmetrical with respect to one another and with respect to themselves as previously noted and as seen, for example, in FIG. 6B.

It is believed that the previously described frame arm arrangements deflects or redirects heat flow impacting the lateral surfaces of the sprinkler frame toward the sprinkler axis and in particular toward a directly loaded thermal trigger, such as for example, a glass bulb type thermal trigger disposed on the sprinkler axis. The preferred sprinkler frame arrangements provide the sprinkler assembly with substantially equivalent or consistent thermal sensitivity in all radial directions about the sprinkler axis. Thus, the preferred sprinkler thermally actuates consistently or in accordance with its expected thermal sensitivity when impacted by a heat flow in a direction normal to the first plane P1 and more particularly impacting the lateral surface 46 of the frame arms 28. Accordingly, for a sprinkler assembly incorporating the preferred sprinkler frame and an axially disposed, directly loaded fast response glass bulb thermal trigger, a fast response sprinkler arrangement can be provided. For example, the preferred sprinkler assembly 10 may be embodied in an ESFR sprinkler arrangement, in which the sprinkler can be successfully thermally tested in its "least favorable position" and subject to the other applicable test requirements under UL 1767 and/or FM Approval Standard 2008 with the expected response of its fast response thermal sensitivity. The preferred assembly provides a simplified sprinkler assembly over known sprinkler arrangements that use off-axis thermal triggers or multiple-component thermally sensitive trigger assemblies as previously described.

The preferred sprinkler frame 5 and its frame arms 28 define an axial length between the sealing assembly 23 and the knuckle 32 for use with a known glass bulb type thermal trigger 14, such as for example, the THERMO BULB® F 3 F "Super Fast" fast response glass bulb from JOB®, which is attached to U.S. Provisional Patent Application No. 61/704,414. Alternatively, the sprinkler frame 5 and frame arms 28 can be configured and spaced to accommodate other axially disposed and directly loaded glass bulb type thermal triggers having different axial lengths or diameters provided that the frame arms 28 facilitates substantially consistent thermal sensitivity about the sprinkler axis for the given trigger as described herein.

Figure 5A:
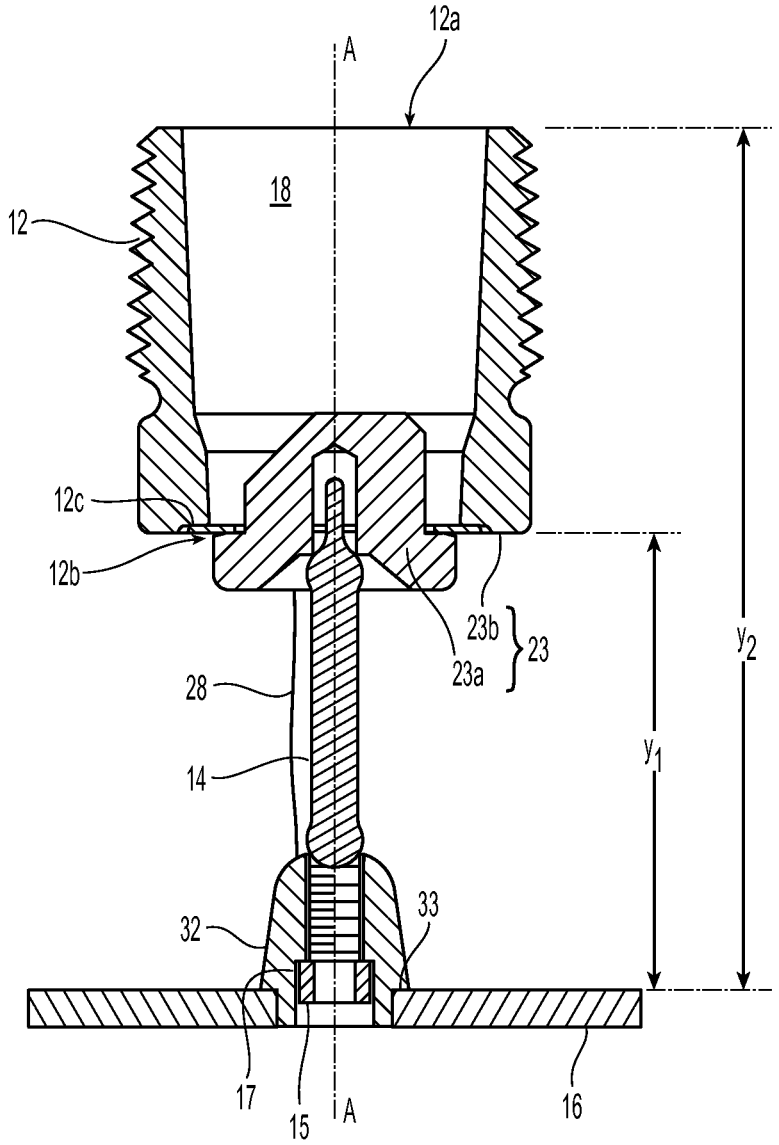
FIG. 5A illustrates a cross-sectional view of the sprinkler assembly taken along the axis VA-VA in the sprinkler assembly FIG. 1.
Figure 5B:
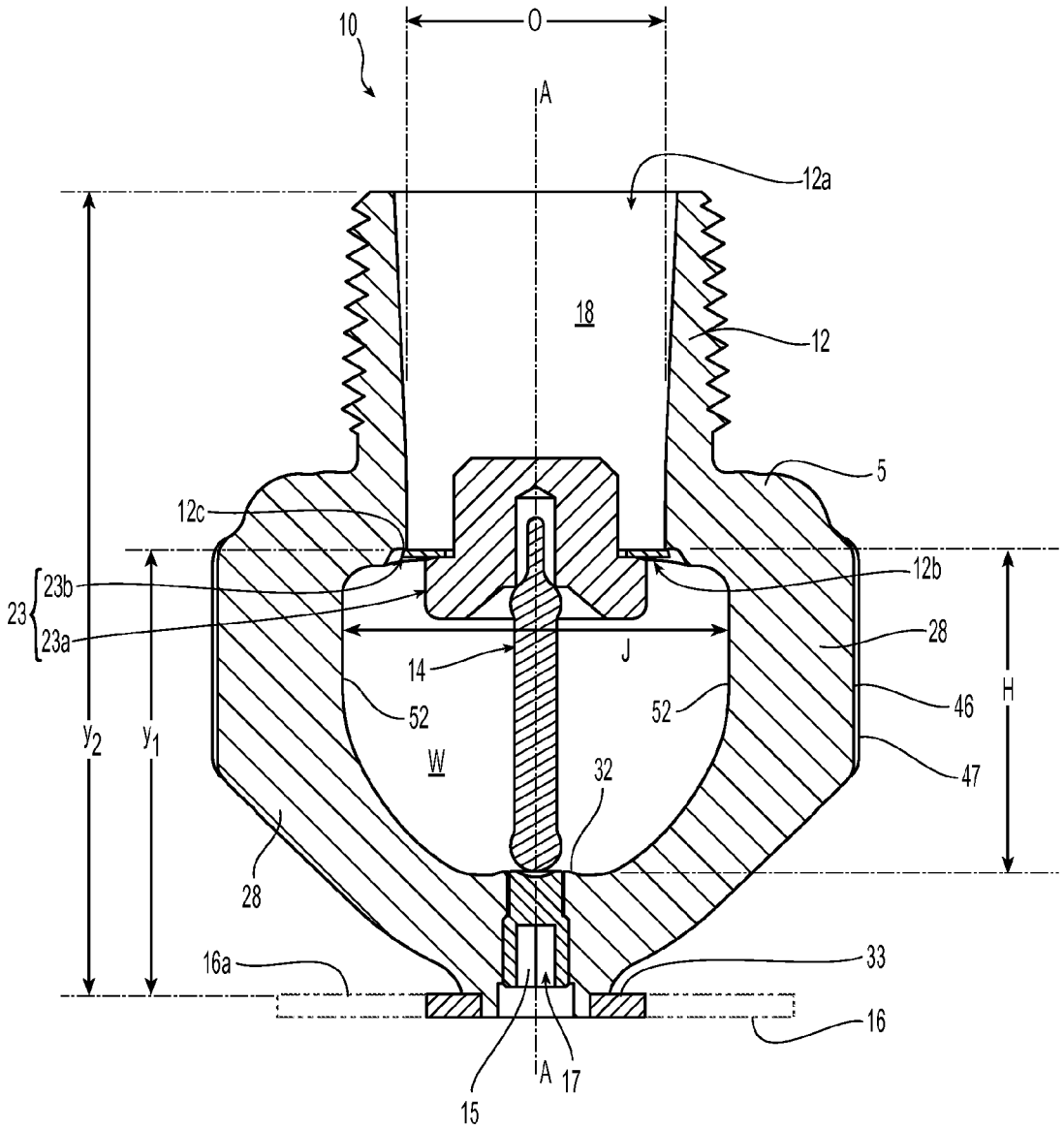
FIG. 5B illustrates a cross-sectional view of the sprinkler assembly taken along the axis VB-VB in the sprinkler assembly FIG. 1.

As previously described and with reference to FIGS. 1, 5A and 5B, the frame arms 28 extend axially from the sprinkler body 12 and converge at the frame knuckle 32 to support a preferably depending fluid deflector 16. More specifically, the distal end of the frame knuckle 32 defines a landing 33 for engaging and supporting the deflector 16. The deflector 16 is affixed to the sprinkler frame 5 by staking or deforming the distal end of the knuckle 32 or by any other mechanical means for joining the components. The configuration of the frame arms 28 define the axial distance between the body 12 and the knuckle 32 and its landing 33. Accordingly, the frame arms 28 can define a first axial length Y1 between the distal outlet 12*b* (more particularly the sealing surface 12*c*) and the proximal surface 16*a* of the deflector 16 or a second axial length Y2 between the proximal inlet 12*a* and the proximal surface 16*a* of the deflector.

Referring to FIGS. 5A and 5B, the body 12 defines a first internal passageway 18 that extends axially to define the central longitudinal sprinkler axis A-A. Disposed in the distal outlet 12*b* is the seal assembly 23. The seal assembly 23 preferably includes a plug 23*a* which defines a bulb seat and preferably a chamber for engaging and axially supporting the proximal end of the preferred glass bulb trigger 14. Preferably, the tapered proximal tip of the glass-bulb type trigger is disposed within the chamber of the plug. Disposed about the plug 23*a* is a spring seal 23*b*, such as for example, a compressible Bellville spring which biases the seal assembly 23 away from the outlet seal surface 12*c*. The outlet seal surface 12*c* defines an orifice diameter O of the passageway 18. To compress the seal 23*b* against the seal surface 12*c* and axially support the thermal trigger 14 at its distal end is a loading element 15 which is preferably a threaded load screw 15 which engages a preferably complimentarily threaded bore 17 of the knuckle 32. The seal surface 12*c* to the knuckle 32 defines a preferred height H of the window W. Engaging the load screw 15 with the thermal trigger 14 to its unactuated position axially aligned along the sprinkler axis A-A transfers a load on the spaced apart frame arms 28. The medial surfaces 52 of the frame arms 28 define a preferred width J of the window W. For a preferred embodiment of the sprinkler 10, the first axial length Y1 is approximately 1.25 inches and the second axial length Y2 is approximately 2.25 inches. The arms 28 of the frame 5 define a preferred window W having a height H of about one inch (1 in.) and more preferably about 0.85 inch; and a window width J of about 1 inch. For the preferred nominal K-Factor of 14.0 GPM/$(PSI)^{1/2}$ the orifice defines a preferred diameter O of about 0.7 inch.

Coupling the sprinkler 10 to a fluid supply line and delivering a fluid under pressure to the inlet 12*a* directly loads the thermal trigger 14. More specifically, the seal assembly 23 seals the distal end 12*b* of the sprinkler 10 against fluid pressure delivered to the sprinkler inlet 12*a*. The load from the fluid pressure in the unactuated state of the sprinkler is distributed over the thermal trigger 14 and the frame arms 28. The fluid load is a function of the delivered pressure and the geometry of the passageway 18 and the distal outlet 12*b*.

The actuated state of the sprinkler also transfers a load to the frame arms. Water discharged from the sprinkler body 12 impacts the distally spaced deflector 16 which places a load on the sprinkler frame arms 28. The flow rate from the sprinkler body 12 is a function of the geometry of the passageway 18 and more particularly the orifice diameter O, which can be characterized by a discharge coefficient or K-factor. The discharge coefficient or K-factor of a sprinkler allows for an approximation of flow rate to be expected from an outlet of a sprinkler based on the square root of the pressure of fluid fed into the inlet of the sprinkler As used herein, the K-factor is defined as a constant representing the sprinkler discharge coefficient, that is quantified by the flow of fluid in gallons per minute (GPM) from the sprinkler outlet divided by the square root of the pressure of the flow of fluid fed into the inlet of the sprinkler passageway in pounds per square inch (PSI). The K-factor is expressed as GPM/$(PSI)^{1/2}$. Industry accepted standards, such as for example, the National Fire Protection Association (NFPA) standard entitled, "NFPA 13: Standards for the Installation of Sprinkler Systems" (2010 ed.) ("NFPA 13") provides for a rated or nominal K-factor or rated discharge coefficient of a sprinkler as a mean value over a K-factor range (NFPA 13, Chapters 3 and 12 are attached to U.S. Provisional Patent Application Nos. 61/704,414). For example for a K-factor 14 or greater, NFPA 13 provides the following nominal K-factors (with the K-factor range shown in parenthesis): (i) 14.0 (13.5-14.5) GPM/$(PSI)^{1/2}$; (ii) 16.8 (16.0-17.6) GPM/$(PSI)^{1/2}$; (iii) 19.6 (18.6-20.6) GPM/$(PSI)^{1/2}$; (iv) 22.4 (21.3-23.5) GPM/$(PSI)^{1/2}$; (v) 25.2 (23.9-26.5) GPM/$(PSI)^{1/2}$; and (vi) 28.0 (26.6-29.4) GPM/$(PSI)^{1/2}$; or a nominal K-factor of 33.3 GPM/$(PSI)^{1/2}$ which ranges from about (31.8-34.8 GPM/$(PSI)^{1/2}$).

The flow is directly proportional to the K-factor of the sprinkler Therefore the fluid flow impact on the deflector 16 and the load on the frame arms 28 increases with increasing K-factor. Preferably for any given K-factor, the frame 5 and its arms 28, are configured to meet the requirements of industry accepted strength test standards, such as for example, the test described in Section 26 of the UL Standard for Early-Suppression Fast-Response Sprinklers UL 1767 (2010) which is attached to U.S. Provisional Patent Application No. 61/704,414. As described in the exemplary UL 1767 test, a frame arm must not show permanent distortion in excess of 0.2 percent when subjected to a test loading as described therein.

Figure 7A:
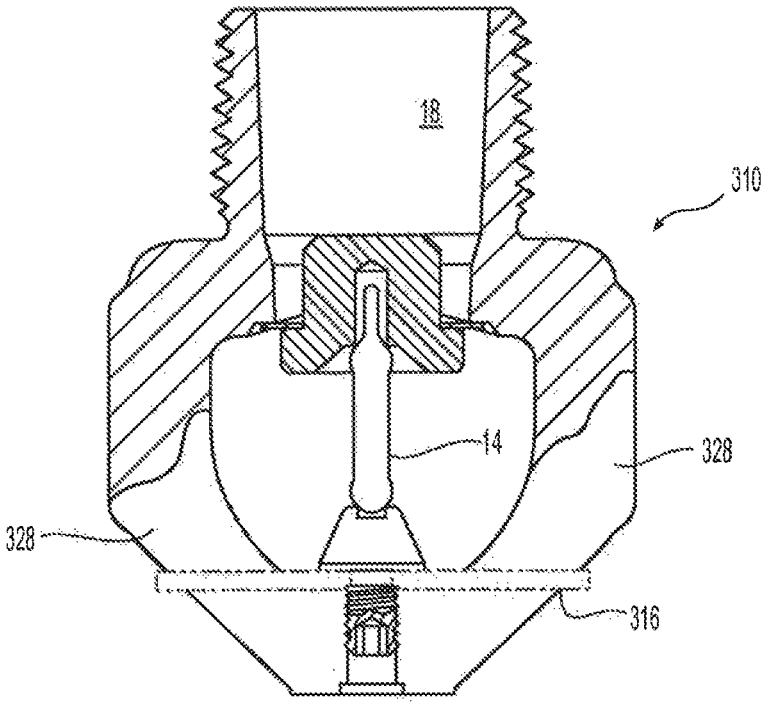
FIG. 7A illustrates a partially cross-sectional view of another preferred embodiment of a sprinkler assembly.
Figure 7B:
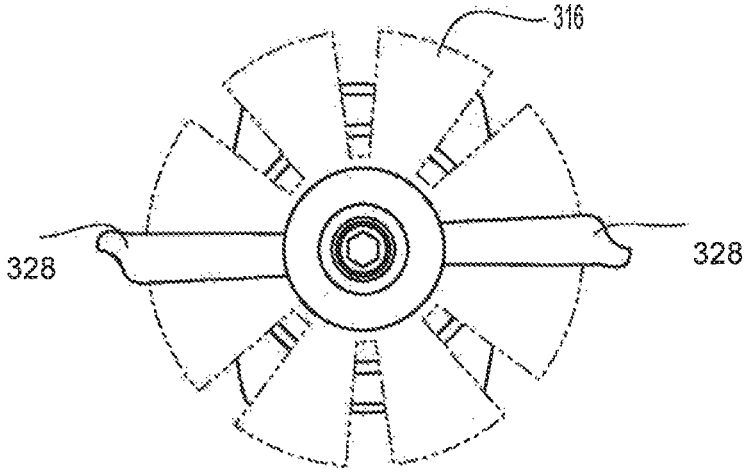
FIG. 7B illustrates a plan view of the sprinkler of FIG. 7A.

For the preferred embodiment shown in FIGS. 1 and 2, the frame arms 28 are preferably configured for: (i) supporting a glass bulb type thermal trigger; and (ii) supporting a deflector 16 in a pendent configuration and at a spaced distance from a body 12 defining a preferred nominal K-factor of 14 GPM/(PSI)$^{1/2}$. Although the frame arms are shown supporting the deflector 16 such that the deflector is external to the sprinkler frame window W, the frame arms may be alternatively configured to provide for a deflector supported internally to the sprinkler window W, as seen for example, in U.S. Pat. No. 6,336,509. Shown in FIGS. 7A and 7B is an exemplary embodiment of a sprinkler assembly 310 with deflector 316 disposed internally to the frame arm 328.

Moreover referring to FIGS. 1 and 5B, the frame 5 and its frame arms 28 may be configured for larger K-factors provided the resulting sprinkler assembly supports an axially disposed directly loaded glass bulb type thermal trigger 14, and satisfies the requisite strength requirements. More preferably, the sprinkler frame in combination with the thermal trigger facilitates a substantially consistent thermal sensitivity of the trigger 14 sensitivity about the sprinkler axis A-A. As noted above, the fluid load on the thermal trigger 14 is a function of the passageway 18 and distal outlet 12*b* geometry, and more particularly directly related to the K-factor of the sprinkler Accordingly, for large K-factor sprinklers, i.e., a nominal 16.8 GPM/(PSI)$^{1/2}$ or greater, an axially disposed, directly loaded glass-type bulb 14 is configured to withstand the fluid load while maintaining its desired thermal responsiveness. In one exemplary embodiment of a sprinkler assembly having a nominal K-factor of 16.8 GPM/(PSI)$^{1/2}$, the first axial length Y1 is about 2.4 inches and the second axial length Y2 is about 3.4 inches. The arms 28 of the frame 5 define a preferred window W having a height H of about 1.9 inches and a window width J of about 1.1 inch. For the preferred nominal K-Factor of 16.8 GPM/(PSI)$^{1/2}$ the orifice defines a preferred diameter O of about 0.8 inch. In another exemplary embodiment of a sprinkler assembly having a nominal K-factor of 25.2 GPM/(PSI)$^{1/2}$, the first axial length Y1 is approximately 2.4 inches and the second axial length Y2 is approximately 3.7 inches. The arms 28 of the frame 5 define a preferred window W having a height H of about 1.9 inches and a window width J of about 1.2 inch. For the preferred nominal K-Factor of 25.2 GPM/(PSI)$^{1/2}$ the orifice defines a preferred diameter O of about 0.95inch.

A known glass-bulb type thermal trigger includes an elongate hollow cylindrical or barrel shaped tubular enclosure. Enclosed within the bulb is an expansible breaking fluid, which expands and breaks the bulb at a predetermined release temperature. Glass-bulb type triggers are constructed to provide for the requisite strength to withstand the anticipated axial loading of the sprinkler assembly. Moreover, glass-bulb type trigger constructions satisfy strength requirements while providing desired thermal sensitivity and/or reduced response times. The "RTI" is a measure of thermal sensitivity and is related to the thermal inertia of a heat responsive element of a sprinkler Under NFPA 13, Section 3.6.1, a "fast response" sprinkler is defined as a sprinkler having a thermal element with an RTI of 50 m$^{1/2}$sec$^{1/2}$ or less; and a "standard response" sprinkler is defined as a sprinkler having a thermal element with an RTI of 80 m$^{1/2}$sec$^{1/2}$ or more. The bulb length, diameter, wall thickness and bulb geometry can define a ratio of the heat-absorbing surface of the bulb to the volume within the bulb to be heated to provide the desired responsiveness and strength of glass-bulb type trigger. For example, with reference to the bulb of ATTACHMENT 3 of U.S. Provisional Patent Application No. 61/704,414, a glass-bulb construction provides for enlarged ends of the bulb to define a "bone shape design" which strengthens the bulb for axial loading and reduces the diameter of the bulb to define the ratio of the heat-absorbing ratio of the bulb to the volume of expansible fluid within the bulb to be heated to provide for the desired thermal responsiveness.

In addition to the construction of the glass enclosure of the bulb type trigger, the desired sensitivity may be realized by the appropriate physical properties of the expansible liquid including, for example, thermal conductivity and viscosity. Moreover, the response time of a thermal trigger may be reduced by lowering the heat capacity of the expansible liquid while providing for high heat absorption. For fast response triggers, the expansible liquid preferably defines a high ratio of the coefficient of thermal expansion to compressibility. Given the parameters affecting the strength and responsiveness of the trigger, a glass-bulb type thermal trigger may be configured to have adequate strength and acceptable responsiveness for use as an axially aligned directly loaded glass-bulb type trigger with the preferred sprinkler frame 5 defining a nominal K-factor of greater than 14.0 GPM/(PSI)$^{1/2}$ to provide for a fast response suppression sprinkler, for example, an ESFR sprinkler having a nominal K-factor of 16.8 or 25.2 GPM/(PSI)$^{1/2}$.

The preferred sprinkler assembly 10 of FIG. 1 includes a simplified thermal trigger construction of only the glass-bulb with the expansible fluid contained therein. When combined with the sprinkle frame 5 and arms 28 as previously described, the resulting sprinkler assembly provides for consistent thermal responsiveness or sensitivity about the sprinkler axis A-A. Accordingly in a thermal sensitivity test, the preferred sprinkler assembly with the axially disposed trigger will actuate, regardless of its orientation to the flow and source of heat, so as to demonstrate a thermal sensitivity within an accepted range for the predetermined or expected response of the trigger. For example, a preferred sprinkler assembly 10 having a predetermined fast response glass-bulb-type trigger will actuate, in response to a thermal sensitivity test, with a resultant RTI ranging between 19-36 m$^{1/2}$-sec$^{1/2}$. Alternatively or in addition to, the preferred sprinkler 10 provides for consistent thermal sensitivity about the sprinkler axis such that for a thermal trigger defining a nominal predetermined RTI and/or a predetermined nominal release temperature range or rating, the preferred sprinkler assembly will actuate in response to an activation event within the nominal RTI and/or nominal release temperature independent of the location of the activation event about the sprinkler axis. Thus, a preferred embodiment of the sprinkler 10 thermally tested in each of the "most favorable" and "least favorable" positions with respect to heat flow satisfactorily actuates or responds within an acceptable range of its nominal predetermined RTI and/or nominal release temperature of the thermal trigger of the assembly. For example, the preferred sprinkler assembly will actuate to demonstrate an actual sensitivity and at an actual release temperature that is within about four percent (4%) of the nominal predetermined RTI and/or nominal release temperature when thermally tested in each of the "most favorable" and "least favorable" positions with respect to heat flow.

Although the axially aligned directly loaded glass-bulb type thermal trigger provides a more simplified sprinkler assembly arrangement, the thermal trigger may include additional heat conducting structures to provide for the desired responsiveness, such as for example, external heat conducting fins. Moreover, although the preferred arrangement includes a glass bulb trigger axially disposed along the sprinkler axis, it should be understood the sprinkler frame 5 may be used with an off-axis glass-bulb type trigger or other types of triggers, such as for example a lever and strut solder assembly, disposed on axis or off axis.

An automatic sprinkler may be configured for addressing a fire in a particular mode such as for example, control mode or suppression mode. A "listed" sprinkler for fire suppression is a sprinkler that has been tested, verified and published in a list by an industry accepted organization, such as for example, FM and UL as a sprinkler being suitable for the specified purpose of fire suppression. Fire suppression is defined by NFPA 13, Section 3.3.10 as "[s]harply reducing the heat release rate of a fire and preventing its regrowth by means of direct and sufficient application of water through the fire plume to the burning fuel surface." One form of suppression mode is the previously identified Early Suppression Fast Response (ESFR) which is defined under NFPA 13, Section 3.6.4.2 as a sprinkler having a thermal sensitivity, i.e., response time index ("RTI") of 50 meter $^{1/2}$second$^{1/2}$ ("m$^{1/2}$sec$^{1/2}$") or less and "listed" for its capability to provide fire suppression of specific high-challenge fire challenges. As previously noted, the thermal responsiveness and sensitivity of the glass-type trigger can be defined by the construction of the glass bulb enclosure and the physical properties of the expansible liquid contained therein.

One particular preferred embodiment of the sprinkler assembly 10 provides for a nominal K-14 ESFR pendent type sprinkler Due to its sprinkler frame 5 and frame arm 28 arrangement to provide the substantially uniform or consistent thermal sensitivity about the sprinkler axis A-A, the preferred sprinkler assembly 10 can satisfy the thermal sensitivity testing required of ESFR sprinklers in each of the "most favorable position" and the "least favorable position" under, for example, UL 1767 and/or FM Approval Standard Class No. 2008. Accordingly, the preferred sprinkler assembly 10 in which the thermal trigger 14 is a fast response trigger, i.e., the sprinkler actuates as required when a sufficient heat flow is directed toward and impacts the lateral surface of the sprinkler for redirection/deflection toward the trigger, i.e., actuates with an RTI ranging between 19-36 m$^{1/2}$-sec$^{1/2}$. However, as previously noted, the applicability of the preferred sprinkler frame 5 is not limited to ESFR nor fast response applications. Rather, the sprinkler may be used in a standard, control mode, specific application sprinkler applications or other standard response applications. Moreover, the preferred sprinkler assemblies are well suited for fast response applications, the sprinkler frame may be alternatively combined with a glass-bulb type trigger having an RTI of 100 m$^{1/2}$sec$^{1/2}$ or greater so as to provide for standard response.

Again, the preferred sprinkler frame provides a compact sprinkler assembly. More specifically, when the sprinkler frame 5 is configured as an ESFR sprinkler with a nominal K-factor of 14.0 GPM/(PSI)½, with the preferred distal outlet-to-deflector distance Y1 and proximal inlet-to-deflector distance Y2 previously described, it is believed that the preferred assembly provides a more compact and more specifically an axially shorter assembly as compared to known existing fast response and more particular, known ESFR sprinklers. It is believed that other known nominal 14.0 GPM/(PSI)½ K-factor ESFR sprinklers have corresponding axial lengths pairs (Y1): (Y2) in inches of: (i) 1.8: 2.7; (ii) 1,9: 3.0; and (iii) 1.6 : 2,7. The compact nature of the preferred sprinkler frame 5 minimizes the material requirements for forming the frame. More preferably, as detailed above, the preferred embodiments provide for a sprinkler including a frame 5 having a body 12 having an inlet 12*a*, an outlet 12*b* and an internal passageway 18 extending between the inlet 12*a* and the outlet 12*b* to define a longitudinal sprinkler axis and a nominal K-factor of at least 14.0 GPM/(PSI)½, with two frame arms 28 extending distally about the body 12. The frame arms 28 support the fluid deflecting structure 16 to define a preferred outlet-to-deflector distance Y1 ranging from about 1 inch to about 2.5 inches and an inlet-to-deflector distance Y2 ranging from about 1 inch to about 3.5 inches. A preferably fast response thermally responsive trigger 14 disposed in the frame window defined by the frame arms to support a seal assembly in the outlet 12*b*, in which the frame window has an axial window height ranging between about 1 inch and about 2 inch and a window width of about 1 inch.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following Features of the Invention, and equivalents thereof.

What is claimed is:

1. A sprinkler, comprising:

a body having an inlet, an outlet and an internal passageway extending between the inlet and the outlet to define a longitudinal sprinkler axis and a nominal K-factor of at least 14.0 GPM/(PSI)$^{1/2}$;

a seal assembly disposed in the outlet to occlude the sprinkler outlet, a fluid deflecting member spaced from the outlet at a first axial distance, the fluid deflecting member being spaced from the inlet at a second axial distance;

a fast response thermally responsive trigger disposed axially aligned along the sprinkler axis between the seal assembly and the deflecting member, the trigger having a nominal thermal sensitivity and a nominal temperature rating; and two frame arms extending distally from the body disposed about the thermally responsive trigger and supporting the fluid deflecting member from the outlet and the inlet, each frame arm defining a surface profile such that the thermal trigger responds to an activation event with the nominal thermal sensitivity and at the nominal temperature rating independent of the location of the activation event about the sprinkler axis, wherein each frame arm has a first portion extending parallel to the sprinkler axis and a second portion extending toward the sprinkler axis, the first portion having a lateral surface and a medial surface relative to the sprinkler axis, the first portions of the frame arms defining cross-sectional areas that are asymmetrical with respect to one another about a first plane bisecting the body with the sprinkler axis disposed in the first plane; and wherein each cross-sectional area is asymmetric about a second plane intersecting and perpendicular to the first plane with the sprinkler axis disposed along the intersection of the first plane and second plane, wherein the lateral surface of each first portion defines an undulation.

2. The sprinkler of claim 1, wherein the nominal thermal sensitivity defines a RTI of less than 100 $m^{1/2}sec^{1/2}$ or less.

3. The sprinkler of claim 2, wherein the nominal thermal sensitivity defines a RTI of 80 $m^{1/2}sec^{1/2}$ or less.

4. The sprinkler of claim 3, wherein the nominal thermal sensitivity defines a RTI of 50 $m^{1/2}sec^{1/2}$ or less.

5. The sprinkler of claim 4, wherein the nominal thermal sensitivity defines a RTI of 40 $m^{1/2}sec^{1/2}$ or less.

6. The sprinkler of claim 5, wherein the nominal thermal sensitivity defines a RTI ranging from 19 $m^{1/2}sec^{1/2}$ to 36 $m^{1/2}sec^{1/2}$.

7. The sprinkler of claim 1, wherein the undulation defines a sine wave having a first end point, a second end point and an inflection between the first and second end points.

8. The sprinkler of claim 1, wherein each of the first portion of each frame arm includes a first surface and a second surface opposed to the first surface, each of the first and second surfaces connecting the lateral surface to the medial surface in each of the first portions of each frame arm, at least one of the first and second surfaces including one or more surface projections having a profile that is any one of curved, triangular or square.

9. The sprinkler of claim 8, wherein the first plane being equidistantly disposed between the two frame arms, the first surface defining a first acute angle relative to a line parallel to the second plane ranging from about 5° to about 10°, the second surface defining a second acute angle relative to a line parallel to the second plane which ranges from about 1° to about 5°.

10. The sprinkler of claim 1, wherein the fast response thermally responsive trigger is a glass-bulb type trigger consisting of a glass enclosure and an expansible fluid in the enclosure.

11. The sprinkler of claim 1, wherein the K-Factor is a nominal K-Factor of 14.0 GPM/$(PSI)^{1/2}$, the first axial distance is about 1.25 inches and the second axial distance is about 2.25 inches.

12. The sprinkler of claim 1, wherein the K-Factor is a nominal K-Factor of 16.8 GPM/$(PSI)^{1/2}$, the first axial distance is about 2.4 inches and the second axial distance is about 3.4 inches.

13. The sprinkler of claim 1, wherein the K-Factor is a nominal K-Factor of 25.2 GPM/$(PSI)^{1/2}$, the first axial distance is about 2.4 inches and the second axial distance is about 3.7 inches.

14. A sprinkler comprising:

a frame having a body having an inlet, an outlet and an internal passageway extending between the inlet and the outlet to define a longitudinal sprinkler axis, the frame including two frame arms extending distally from the body, each arm having a portion defining cross-sectional area with a lateral surface and a medial surface relative to the sprinkler axis, the medial surfaces being spaced about a first plane bisecting the body with the sprinkler axis disposed in the first plane;

a seal assembly disposed in the outlet to occlude the sprinkler outlet;

a fluid deflecting structure supported by the frame arms; and a thermally responsive glass-bulb type trigger disposed between the frame arms and axially aligned along the sprinkler axis between the seal assembly and the frame to support the seal assembly in the outlet, wherein the cross-sectional areas of the frame arms are asymmetrical with respect to one another about the first plane and each cross-sectional area is asymmetric about a second plane perpendicular to the first plane with the sprinkler axis disposed along the intersection of the first pane and the second plane, wherein the lateral surface of each arm includes an undulation having a first end, a second end, and an inflection between the first and second ends.

15. The sprinkler of claim 14, wherein the undulation defines a sine wave.

16. The sprinkler of claim 14, wherein the trigger has an RTI of less than 100 $m^{1/2}sec_{1/2}$ or less.

17. The sprinkler of claim 16, wherein the trigger has an RTI of 80 $m^{1/2}sec^{1/2}$ or less.

18. The sprinkler of claim 17, wherein the trigger has an RTI of 50 $m^{1/2}sec^{1/2}$ or less.

19. The sprinkler of claim 18, wherein the trigger has an RTI of 40 $m^{1/2}sec^{1/2}$ or less.

20. The sprinkler of claim 19, wherein the trigger has an RTI ranging from 19 $m^{1/2}sec^{1/2}$ to 36 $m^{1/2}sec^{1/2}$.

21. The sprinkler of claim 14, wherein each frame arm has a first portion extending parallel to the sprinkler axis and a second portion extending toward the sprinkler axis.

22. The sprinkler of claim 21, wherein each of the first portion of each frame arm includes a first surface and a second surface opposed to the first surface, each of the first and second surfaces connecting the lateral surface to the medial surface in each of the first portions of each frame arm, at least one of the first and second surfaces including one or more surface projections having a profile that is any one of curved, triangular or square.

23. The sprinkler of claim 22, wherein the first plane is equidistantly disposed between the two frame arms, the first surface defining a first acute angle relative to a line parallel to the second plane ranging from about 5° to about 10°, the second surface defining a second acute angle relative to a line parallel to the second plane which ranges from about 1° to about 5°.

24. The sprinkler of claim 23, wherein the first surface defines a lateral-to-medial length of about 0.4 inches and the second surface defines a lateral-to-medial length of about 0.3 inches.

25. The sprinkler of claim 14, wherein the body defines a nominal K-Factor of 14.0 GPI/$(PSI)^{1/2}$, the fluid deflecting structure is spaced from the outlet at a first axial distance, the fluid deflecting structure being spaced from the inlet at a second axial distance, wherein the first axial distance is about 1.25 inches and the second axial distance is about 2.25 inches.

26. The sprinkler of claim 14, wherein the frame arms define a window having a window height in the axial direction of about one inch (1 in.); and a window width of about 1 inch.

27. The sprinkler of claim 26, wherein the frame arms define a maximum lateral surface-to-lateral surface distance across the window of about 1-¾ inches.

28. The sprinkler of claim 14, wherein the body defines a nominal K-Factor of 16.8 GPM/$(PSI)^{1/2}$, the fluid deflecting structure is spaced from the outlet at a first axial distance, the fluid deflecting structure being spaced from the inlet at a second axial distance, wherein the first axial distance is about 2.4 inches and the second axial distance is about 3.4 inches.

29. The sprinkler of claim 28, wherein the frame arms define a window having a window height of about 1.9 inches; and a window width of about 1 inch.

30. The sprinkler of claim 14, wherein the body defines a nominal K-Factor of 25.2 GPM/$(PSI)^{1/2}$, the fluid deflecting structure is spaced from the outlet at a first axial distance, the fluid deflecting structure being spaced from the inlet at a second axial distance, wherein the first axial distance is about 2.4 inches and the second axial distance is about 3.7 inches.

31. The sprinkler of claim 30, wherein the frame arms define a window having a window height of about 1.9 inches; and a window width of about 1 inch.

32. The sprinkler of claim 14, wherein the fluid deflecting structure is disposed internally of the frame arms.

33. A sprinkler comprising:

a frame having a body having an inlet, an outlet and an internal passageway extending between the inlet and the outlet to define a longitudinal sprinkler axis and a nominal K-factor of at least 14.0 GPM/(PSI)$^{1/2}$, the frame including two frame arms extending distally about the body;

a seal assembly disposed in the outlet to occlude the sprinkler outlet;

a fluid deflecting structure supported by the frame arms to define an outlet-to-deflector distance ranging from about 1 inch to about 2.5 inches and an inlet-to-deflector distance ranging from about 1 inch to about 3.5 inches; and a fast response trigger disposed in a frame window defined by the frame arms to support the seal assembly in the outlet, the frame window having a window height ranging between about 1 inch and about 2 inch and a window width of about 1 inch, wherein each frame arm has a first portion extending parallel to the sprinkler axis and a second portion extending toward the sprinkler axis, the first portion having a lateral surface and a medial surface relative to the sprinkler axis, the first portions of the frame arms defining cross-sectional areas that are asymmetrical with respect to one another about a first plane bisecting the body with the sprinkler axis disposed in the first plane; and wherein each cross-sectional area is asymmetric about a second plane intersecting and perpendicular to the first plane with the sprinkler axis disposed along the intersection of the first plane and second plane, the lateral surface of each first portion defining an undulation.

34. The sprinkler of claim 33, wherein the trigger is a glass bulb axially aligned along the sprinkler axis.

35. The sprinkler of claim 33, wherein the K-Factor is a nominal K-Factor of 14.0 GPM/(PSI)$^{1/2}$, the outlet-to-deflector distance is about 1.25 inches, the inlet-to deflector distance is about 2.25 inches and the window height is about 1 inch.

36. The sprinkler of claim 33, wherein the K-Factor is a nominal K-Factor of 16.8 GPM/(PSI)$^{1/2}$, the outlet-to-defector distance is about 2.4 inches, the inlet-to-deflector distance is about 3.4 inches, and the window height is about 1.9 inches.

37. The sprinkler of claim 33, wherein the K-Factor is a nominal K-Factor of 25.2 GPM/(PSI)$^{1/2}$, the outlet-to-deflector distance is about 2.4 inches, the inlet-to-deflector distance is about 3.7 inches, and the window height is about 1.9 inches.

38. The sprinkler of claim 33, wherein the sprinkler is an early suppression faster response (ESFR) sprinkler.

39. A sprinkler, comprising:

a frame having a body having an inlet, an outlet and an internal passageway extending between the inlet and the outlet to define a longitudinal sprinkler axis, the frame including two frame arms extending distally from the body, each arm having a portion with a lateral surface and a medial surface relative to the sprinkler axis, the medial surfaces being equally spaced about a first plane bisecting the body with the sprinkler axis disposed in the first plane;

a seal assembly disposed in the outlet to occlude the sprinkler outlet, a fluid deflecting structure supported by the frame arms; and a thermally responsive glass-bulb type trigger consisting of a glass enclosure and an expansible fluid in the enclosure, the trigger disposed between the frame arms and axially aligned along the sprinkler axis between the seal assembly and the frame to support the seal assembly within the sprinkler outlet, the thermal trigger being a glass bulb having a predetermined nominal thermal sensitivity defining an expected RTI measured in $m^{1/2}sec^{1/2}$ and a nominal predetermined release temperature, wherein each frame arm defines a surface profile such that sprinkler has a consistent thermal sensitivity about the sprinkler axis, the surface profiles of the two frame arms defining cross-sectional areas that are asymmetrical with respect to one another about the first plane and each cross-sectional area is asymmetric about a second plane perpendicular to the first plane with the sprinkler axis disposed along the intersection of the first plane and the second plane, wherein the lateral surface of each arm includes an undulation having a first end, a second end, and an inflection between the first and second ends.

* * * * *